US005732123A

United States Patent [19]

Peralta et al.

[11] Patent Number: 5,732,123

[45] Date of Patent: *Mar. 24, 1998

[54] METHOD AND SYSTEM FOR EXTENDING THE SERVICE LIFE OF AN X-RAY TUBE

[75] Inventors: Eduardo Peralta, Freeport, N.Y.; David V. Habif, Jr., 24 Grandview Ter., Tenafly, N.J. 07670

[73] Assignee: David V. Habif, Jr., Tenafly, N.J.

[ * ] Notice: The term of this patent shall not extend beyond the expiration date of Pat. No. 5,440,608.

[21] Appl. No.: 691,613

[22] Filed: Aug. 2, 1996

Related U.S. Application Data

[63] Continuation-in-part of Ser. No. 511,414, Aug. 4, 1995, Pat. No. 5,596,622, which is a continuation-in-part of Ser. No. 90,703, Jul. 13, 1993, Pat. No. 5,440,608.

[51] Int. Cl.[6] ..... H01J 35/10

[52] U.S. Cl. ..... 378/199; 378/200

[58] Field of Search ..... 378/199, 200

[56] References Cited

U.S. PATENT DOCUMENTS

| | | |
|---|---|---|
| 1,987,790 | 1/1935 | Mutscheller . |
| 4,115,697 | 9/1978 | Hounsfield et al. . |
| 4,402,085 | 8/1983 | Distler et al. . |
| 4,405,876 | 9/1983 | Iversen . |
| 4,455,504 | 6/1984 | Iversen . |
| 4,622,687 | 11/1986 | Whitaker et al. . |
| 4,688,239 | 8/1987 | Schaffner et al. . |
| 4,698,983 | 10/1987 | Hechavarria . |
| 4,767,961 | 8/1988 | Koller et al. . |
| 4,841,557 | 6/1989 | Haberrecker et al. . |
| 4,866,743 | 9/1989 | Kroener . |
| 4,918,714 | 4/1990 | Adamski et al. . |
| 4,928,296 | 5/1990 | Kadambi . |

(List continued on next page.)

FOREIGN PATENT DOCUMENTS

4101777A1 8/1992 Germany .

OTHER PUBLICATIONS

L.C. Tighe, "X-Ray Tubes A Technology Review," *Second Source Imaging*, pp. 49–54 (Nov. 1993).

Inmark Corporation, "1994 Replacement X-Ray Tube Price List and Cross Reference Guide," Cover & pp. 34–35.

Draft "Service Manual" from Siemans; Jun. 1983; 15 pages.

Section 5.4 of "Service Manual" from Siemans; 8 pages.

"Supplement to Adjustment Program AS03" from version F onward; from Siemans; May 1985; 40 pages.

"Tune Up Basics"; Jun. 4, 1984; 24 pages.

Supp. EPO Search Report, Appl. No. EP94923534, dated Jun. 14, 1996.

*Primary Examiner*—Don Wong
*Attorney, Agent, or Firm*—Ratner & Prestia

[57] ABSTRACT

A method and system for extending the service life of an x-ray tube wherein the coolant fluid which is circulated through a closed circulation system to remove heat generated by the x-ray tube and provide electrical insulation between anode connections and ground (and/or cathode connections) is regularly filtered and/or changed based on predetermined criteria. Provided for performing the filtering and/or changing is a cart which, preferably, is mobile, portable or otherwise easy and convenient to operate. The cart includes a new oil reservoir, an old oil container, various valves and a bidirectional pump for performing various functions. For example, the cart allows a technician or other skilled individual to connect the cart to a source of new oil for the purpose of filling its new oil reservoir container, this being known as the FILL mode. Also, the cart design allows a user to connect the cart to the cooling system and perform operations such as 1) replacing the existing oil with new oil (FLUSH mode), 2) circulating existing oil, whether new or old, through the circulation system as well as any filters coupled in-line with the circulation path (RECIRCULATE mode), and 3) add new oil to the cooling system from the reservoir (TRIM mode).

18 Claims, 17 Drawing Sheets

U.S. PATENT DOCUMENTS 4,938,315 7/1990 Ohta et al. .
4,949,369 8/1990 Bittl .
5,012,505 4/1991 Zupancic et al. .
5,074,379 12/1991 Batrice .
5,083,307 1/1992 Meinel et al. .
5,086,449 2/1992 Furbee et al. .
5,099,955 3/1992 Mangen et al. .
5,101,641 4/1992 Van Steenburgh, Jr. .
5,168,720 12/1992 Keltner .
5,222,118 6/1993 Gerth .
5,242,032 9/1993 Prestwood et al. .
5,440,608 8/1995 Peralta et al. ..... 378/199
5,596,622 1/1997 Peralta et al. ..... 378/199

METHOD AND SYSTEM FOR EXTENDING THE SERVICE LIFE OF AN X-RAY TUBE

RELATED APPLICATIONS

The present application is a continuation-in-part application of U.S. application Ser. No. 08/511,414 filed Aug. 4, 1995, now U.S. Pat. No. 5,596,622 which is a continuation-in-part application of Ser. No. 08/090,703, filed Jan. 13, 1993, U.S. Pat. No. 5,440,608.

FIELD OF THE INVENTION

The invention generally relates to x-ray tubes and, more particularly, it relates to extending the service life of an x-ray tube.

BACKGROUND OF THE INVENTION

One type of x-ray tube is a computerized tomography (CT) x-ray tube which is used in CT scanners.

FIG. 1 shows one type of CT scanner which is described in U.S. Pat. No. 5,086,449. The CT scanner includes a stationary patient receiving region 10. A gantry 12 is mounted for rotation around the patient receiving region 10. An x-ray tube assembly 14 which produces a radiation beam through an x-ray port across the patient receiving region 10 is mounted to gantry 12 for purposes of rotation. Coolant fluid is circulated between x-ray tube assembly 14 and a cooling system 17 (including heat exchanger and pump) which is also mounted on the gantry 12. The coolant fluid flows through x-ray tube assembly 14 to remove heat created during x-ray generation. Finally, an arc or ring of radiation detectors 28 surround the patient receiving region.

During operation, typically, x-ray tube assembly 14 generates a planar beam of radiation which is then rotated around the body. Various detectors 28, located around the patient, detect the intensity of the beam. Detectors 28 are connected to a computer which, based on intensity readings, generates an image of a slice of the body. The patient is then moved longitudinally through the gantry with the x-ray tube assembly 14 generating slices so that the computer can generate a three-dimensional image of the body.

In the course of generating slices, much heat is generated by x-ray tube assembly 14 and this heat must be removed if the service life of the x-ray tube is not to be unduly reduced. As described above, it is known to cool x-ray tubes by circulating a fluid, typically oil, within the tube and externally through a cooling system to remove as much heat as possible. In addition to being used as vehicle for cooling, the fluid is also used for its dielectric properties in order to insulate the anode connection from ground (and/or the cathode connection).

Even employing this type of fluid for purposes of cooling and electrical insulation, x-ray tubes have a finite service life. There are several causes of x-ray tube failure, most of which are related to thermal characteristics of the x-ray tube. Hence, heat removal is an important concern in attempting to extend the service life of an x-ray tube.

A first type of tube failure is related to excessive anode temperature during a single exposure which may result in localized surface melting and pitting of the anode.

A second type of tube failure results from maintaining the anode at elevated temperatures for prolonged periods. If the thermal stress on an x-ray tube anode is maintained for prolonged periods, such as during fluoroscopy, the thermal capacity of the total anode system and of the x-ray tube housing is the limitation to operation.

During fluoroscopy, the rate of heat dissipation from the rotating target attains equilibrium with the rate of heat input. Although this rate is rarely sufficient to cause surface defects in the target, the tube can fail because of the continuous heat delivered to the coolant fluid, the rotor assembly, and/or the x-ray tube housing.

Coolant fluid, due to continuous heat and repeated arcing, will eventually break down. When the oil breaks down its dielectric properties as well as its ability to carry away heat (i.e. viscosity) are adversely affected. This results in less electrical insulation between the anode connection and ground connections (and/or the cathode connection) which leads to more arcing and, eventually, tube failure. Hence, proper electrical insulation (i.e., maintaining the proper dielectric property of the coolant fluid) is also an important concern in attempting to extend the service life of an x-ray tube.

A third type of failure involves the filament. Because of the high temperature of the filament, tungsten atoms are slowly vaporized and plate the inside of the glass envelope, even with normal use. This tungsten, along with that vaporized from the anode, disturbs the electrical balance of the x-ray tube, causing abrupt, intermittent changes in tube current, which often leads to arcing and tube failure.

Due to the above-described potential problems in current x-ray tube designs, manufacturers of CT x-ray tubes, which generally cost approximately $25–40,000, typically include a warranty for 40,000 slices, where a slice is a single picture taken by the CT scanner.

In a typical radiology center, one CT scanner running full time uses any where from 1–4 x-ray tubes a year which becomes very expensive. Obviously, it would be very advantageous, in terms of time and money, for a radiology center or the like to be able to extend the service life of an x-ray tube.

SUMMARY OF THE INVENTION

In a radiographic apparatus having an x-ray tube coupled to a cooling system and the cooling system circulates an existing fluid through a closed circulation system which includes the x-ray tube to remove heat and provide electrical insulation, the present invention involves a system and method for extending the service life of the x-ray tube without removing the x-ray tube. First, the invention determines, based on predetermined criteria, that the existing fluid has degraded below a predetermined tolerance. Next, the closed circulation system is opened in order to gain access to the existing fluid; then, the existing fluid is replaced with new fluid by way of the opening. Finally, the circulation system is closed.

BRIEF DESCRIPTION OF THE FIGURES

The invention is best understood from the following detailed description when read in connection with the accompanying drawings, in which.

DESCRIPTION OF THE INVENTION

A. Overview

Figure 1:
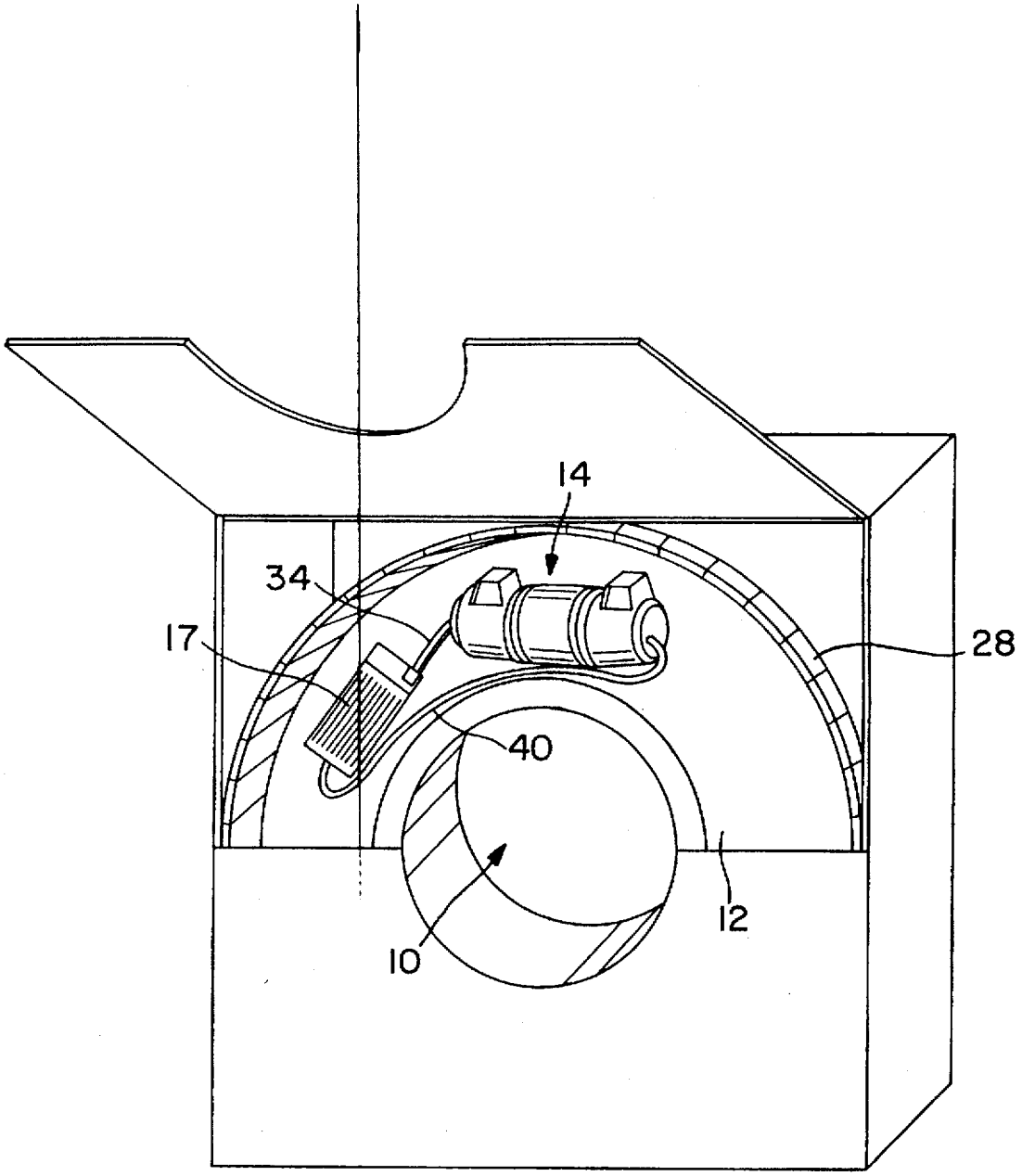
FIG. 1 (PRIOR ART)
FIG. 1 shows a prior art CT device including an x-ray tube assembly and cooling system.

As described in the BACKGROUND with reference to FIG. 1, the coolant fluid circulated throughout the closed circulation system serves at least two purposes: (1) providing electrical insulation between the anode connection and ground (and/or the cathode connection) and (2) removing heat generated by the x-ray tube assembly. Inevitably, the oil breaks down; in other words, its dielectric properties, as well as its ability to carry away heat (i.e., viscosity), degrades. Also, adding to the overall degradation, an increased number of particulate matter accumulates in the coolant oil due to the oil break down from tube-related heat. Thus, to reduce and/or delay x-ray tube failures thereby extending the service life of an x-ray tube, the present invention employs regular coolant fluid filtering and/or changes without removing the x-ray tube from the scanner.

A fluid change, based on predetermined criteria, rejuvenates the cooling system by replacing old fluid with new fluid not only to better carry away the heat but also to provide the proper insulation (i.e., dielectric barrier) between the anode and ground (and/or cathode connections). Providing new fluid with fresh dielectric properties prevents, at least temporarily, the increased arcing which may otherwise occur if the old oil remained in the system and which would eventually result in x-ray tube failure. Periodically filtering the fluid, although not quite as effective as a complete fluid change, also, at least temporarily, extends the viability of the coolant and, thus, tends to extend the service life of the x-ray tube.

X-ray tubes typically include a manufacturer's warranty for approximately 40,000 slices where a slice is a single picture taken by a computerized tomography (CT) scanner. Although x-ray tubes have been known to last as long as 75,000 slices, experiments using the present invention have shown that by performing regular fluid changes the life of an x-ray tube can be substantially extended. In one example, the service life was extended to approximately 300,000 slices; and, another, still functioning, is over 125,000 slices.

Figure 2A:
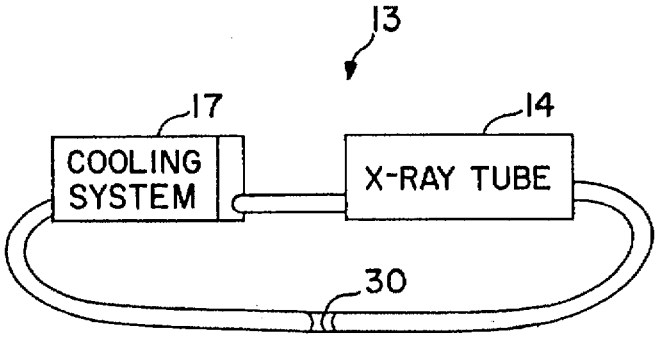
FIG. 2a (PRIOR ART)
FIG. 2*a*, 2*b* and 2*c* illustrate, according to the present invention, an x-ray tube assembly and cooling system configuration for changing the cooling system fluid.

FIG. 2*a* shows a closed circulation system 13 including an x-ray tube assembly 14 and a cooling system 17.

Figure 2B:
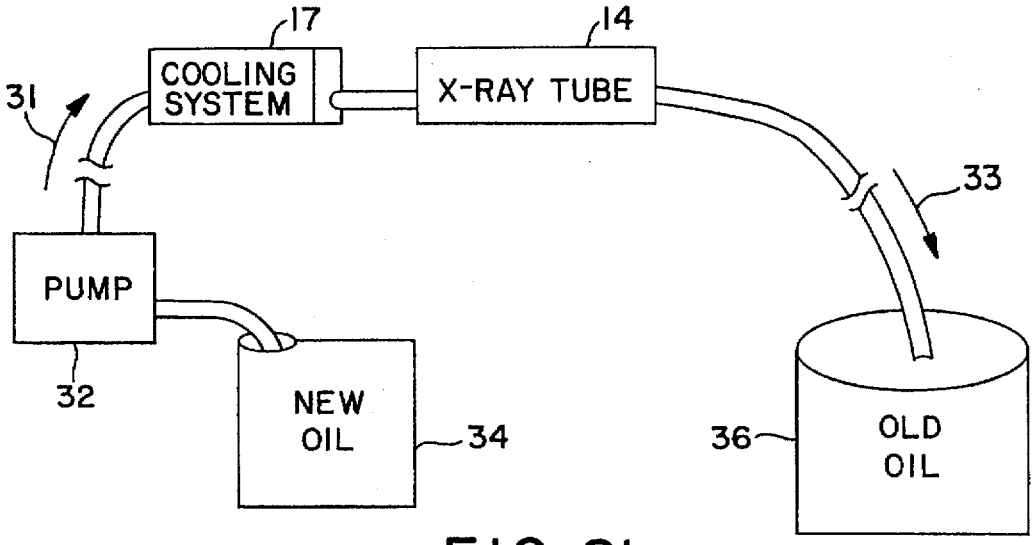

In FIG. 2*b*, an individual (e.g. technician or maintenance specialist) opens closed circulation system 13 to create an access to the fluid which circulates therein. This access may be via a quick-action coupling 30 or it may require breaking a seal. A pump 32 coupled to a source of new oil 34 is coupled to one end of the access point while the other end is situated to feed into a container 36 for holding old oil. When pump 32 is turned on it pumps new oil, as indicated by arrow 31, into the system thereby forcing the old oil out, as indicated by arrow 33, and into old oil container 36. When substantially new oil is detected flowing into old oil container 36, pump 32 is turned off and the access point is closed, thus, reconstructing closed circulation system 13 of FIG. 2*a*.

B. Detailed Description of the Invention

1. Fluid Change

Figure 3:
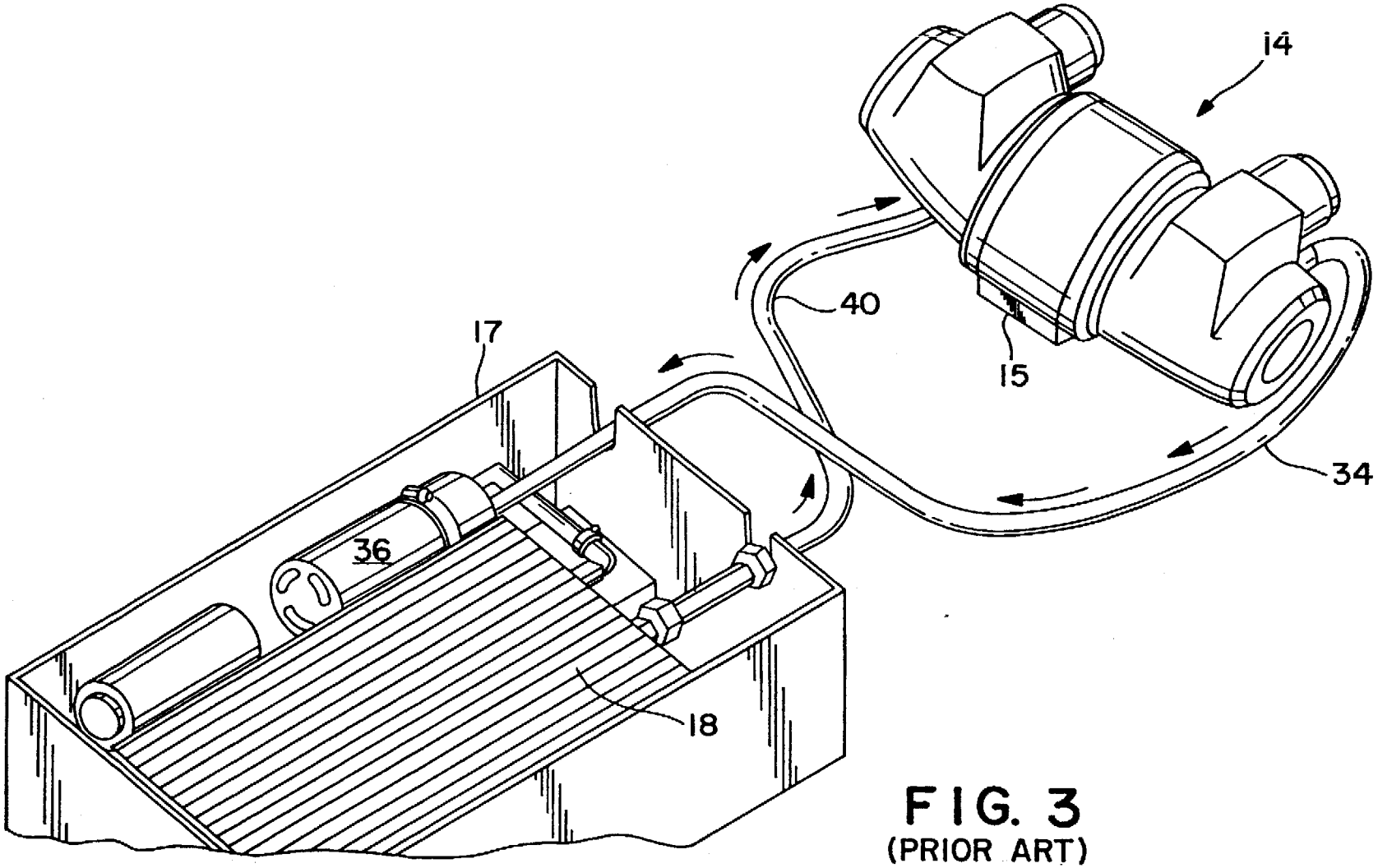
FIG. 3 (PRIOR ART)
FIG. 3 shows additional details of the x-ray tube assembly and cooling system of FIG. 1.

FIG. 3 shows additional details of the prior art x-ray tube assembly 14 and cooling system 17 of FIG. 1. As indicated by the arrows, pump 36 receives hot fluid from line 34 and moves the hot fluid through heat exchanger 18. The cooled fluid is returned to x-ray tube assembly 14 via line 40. Typically, the fluid is oil. In the exemplary embodiment of the present invention, the oil used is a light transformer oil which is initially clear in color but which, after continued use, becomes opaque (e.g., dark brown). It should be understood by those skilled in the art that other fluids suitable for use in an x-ray tube cooling system would also suffice.

The color of the oil, when accessible, is one way to determine when an oil change is necessary. As the oil breaks down and becomes "dirty", the color of the oil becomes darker. If the color of the oil is accessible, then periodic visual inspections can determine when an oil change is needed.

If the color of the oil is not accessible via, for example, an in-line window such as a transparent air-trap, alternate techniques for determining when to change the oil can be employed. Some contemplated alternate techniques include: (1) installing a monitor system for on-line testing of the thermal and/or dielectric properties of the oil, (2) installing an optical sensor in the circulation path which signals when the oil has reached a predetermined color or particulate matter density, and/or (3) changing the oil, albeit less precise, based on other predetermined criteria such as the number of arcs, slices, calender days, patients, etc.

Once it has been determined that the oil needs to be changed, access to the oil needs to be gained. The accessibility of the oil depends on the particular system. In the exemplary embodiment of the present invention, at least one quick-action coupling 30 is used in the system which provides quick and convenient access to the oil. Quick-action coupling 30 operates such that when the coupling is decoupled, both ends automatically close, thus, preventing any oil from spilling out of the system.

However, other systems such as the CT-MAX tube by Eldco, Inc., Ontario, Calif., in which the x-ray tube assembly and cooling system are integrated as a single unit make it more difficult to access the oil. In systems such as this, usually a seal will have to be broken in order to gain access to the oil. Once the oil is changed, however, the seal needs to be repaired. It is contemplated that a quick-action coupling would be permanently installed, with any necessary extension tubing, in order to render subsequent oil changes easier and more convenient.

It should be understood by those skilled in the art that the present invention can be employed by CT scanners which have both the x-ray tube assembly and cooling system mounted on the gantry (e.g., U.S. Pat. No. 5,086,449 and U.S. Pat. No. 4,115,697 which are herein incorporated by reference) or which have the x-ray tube assembly mounted on the gantry and the cooling system located at a stationary location (e.g., U.S. Pat. No. 5,012,505 which is herein incorporated by reference).

Once access has been gained, the oil needs to be changed. Referring back to FIGS. 2*a* and 2*b*, the quick-action coupling 30 is decoupled.

Next, the old oil is replaced by new oil. A pump 32 coupled to a source of new oil 34 is coupled to one end of the access point while the other end is situated to feed into a container 36 for holding old oil. When pump 32 is turned on it pumps new oil into the system thereby forcing the old oil out and into the old oil container 36.

In addition to the oil replacement method described above, another aspect of the present invention is to filter and/or recycle the existing oil.

2. Fluid Filtering

Figure 2C:
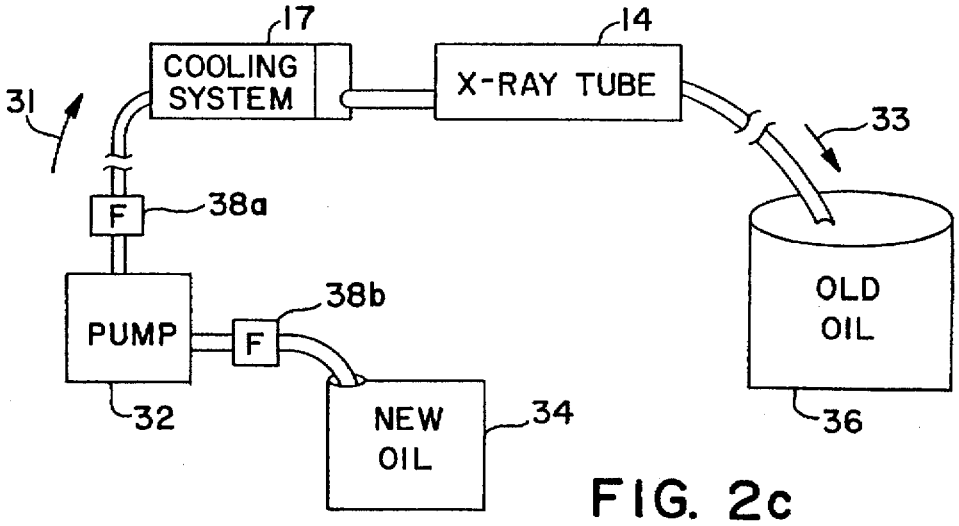
Figure 2D:
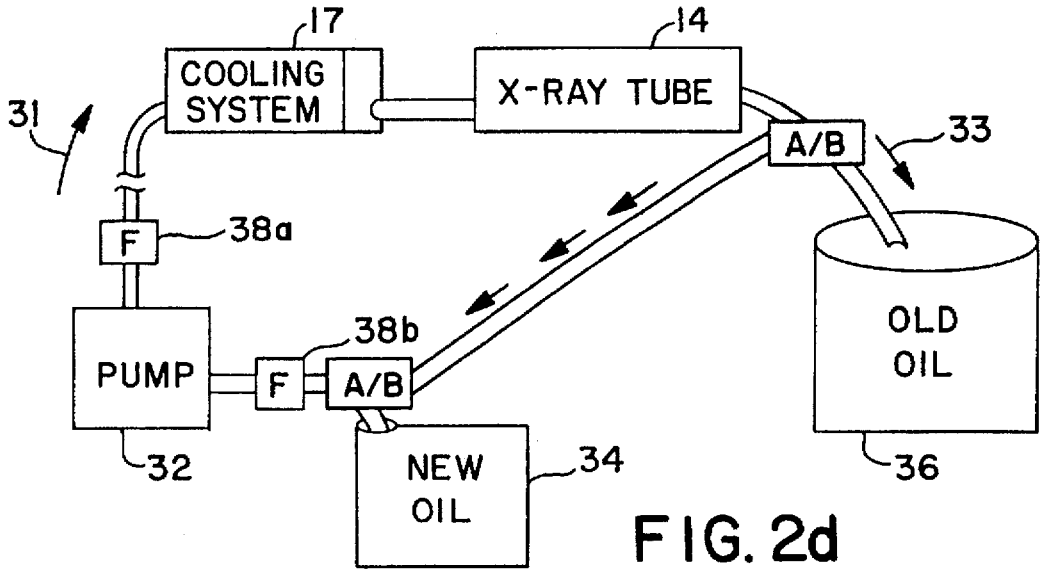
FIG. 2*d* illustrates, according to another aspect of the present invention, an x-ray tube assembly and cooling system configuration for filtering the cooling system fluid.

In particular, FIG. 2*d*, although similar to FIGS. 2*b* and 2*c*, uses filters in a closed-loop manner to filter the existing oil. That is to say, a recycling loop has been added and may possibly be integrated with the first aspect of the present invention. Although replacing the existing oil is preferred for maximum tube life extension, when certain factors (e.g., cost) may be prohibitive, "cleaning" the existing oil at predetermined intervals also tends to extend tube life as compared to no preventive maintenance at all. For example, as special oil is used in the x-ray tube cooling systems, and a closed-loop cooling system contains approximately 5 gallons of oil, oil replacement cost may in some cases become prohibitive.

It should be noted that filtering the oil at predetermined intervals may occur consecutively (i.e., one after another) or it may be intermixed with complete oil changes (i.e., filter, change, filter, change, etc.) or various combinations thereof depending on various factors at a particular scanner site including cost, etc. Moreover, newly replaced oil may be filtered to further ensure that particulate or other types of build up within the closed circulation system have been substantially removed.

Continuing with FIG. 2*d*, shown is the addition of two "A/B" valves which can switch the flow of oil to create a continuous circuitous route for the existing oil through the appropriate filters. In the exemplary embodiment of the present invention, the filters are a 40 micron synthetic polyester filter and a 10 micron cellulose filter. The 40 micron filter filters large contaminant particles greater than 40 microns in size. The 10 micron filter filters minute contaminant particles but not smaller than 10 microns in size. The recycling loop procedure may generally last approximately 30 minutes to allow filtering of the existing oil. Additional details of the various modes of operation including filtering are described in detail below with reference to FIGS. 7–13.

Figure 2E:
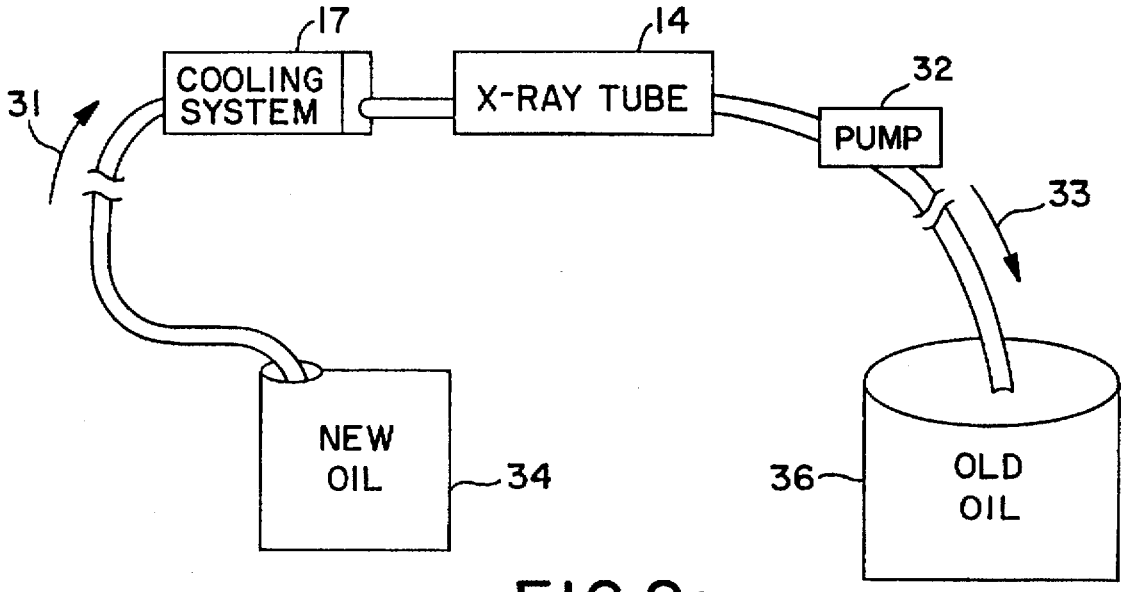
FIG. 2*e–g* are similar to FIGS. 2*b –d* and illustrate, according to another aspect of the present invention, an x-ray tube assembly and cooling system configuration for changing/filtering the cooling system fluid.
Figure 2F:
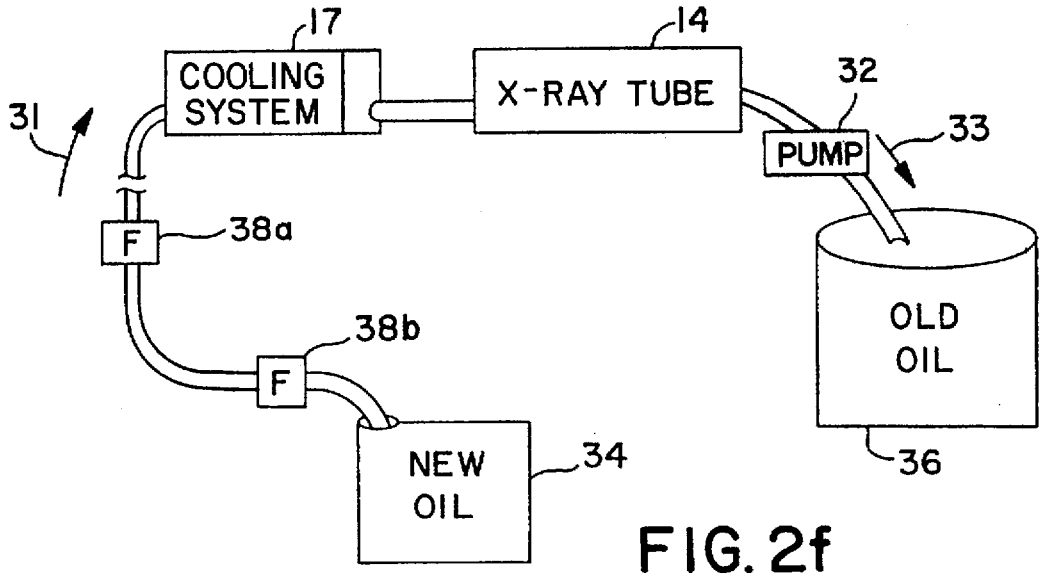
Figure 2G:
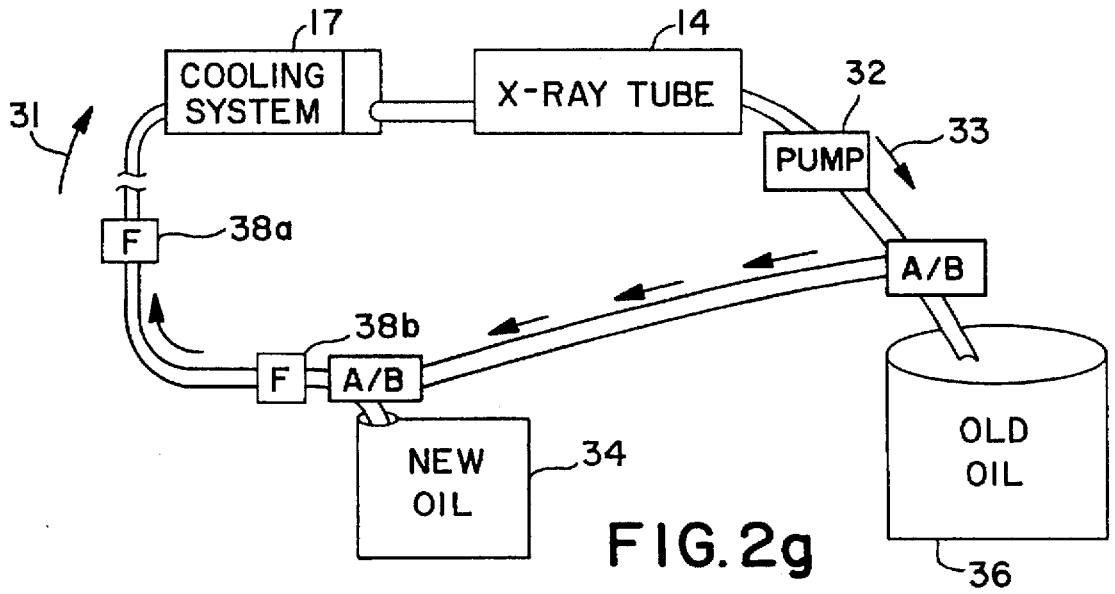

FIG. 2*e–g* are similar to FIGS. 2*b–d* and illustrate, according to another aspect of the present invention, an x-ray tube assembly and cooling system configuration for changing/filtering the cooling system fluid. In particular, FIGS. 2*b–d* show the use of positive pressure by the pump in order to cream or direct the flow of coolant fluid; whereas, FIGS. 2*e–g* show the use of negative pressure by the pump, as represented by the position of the pump, in order to perform the same.

Figure 5:
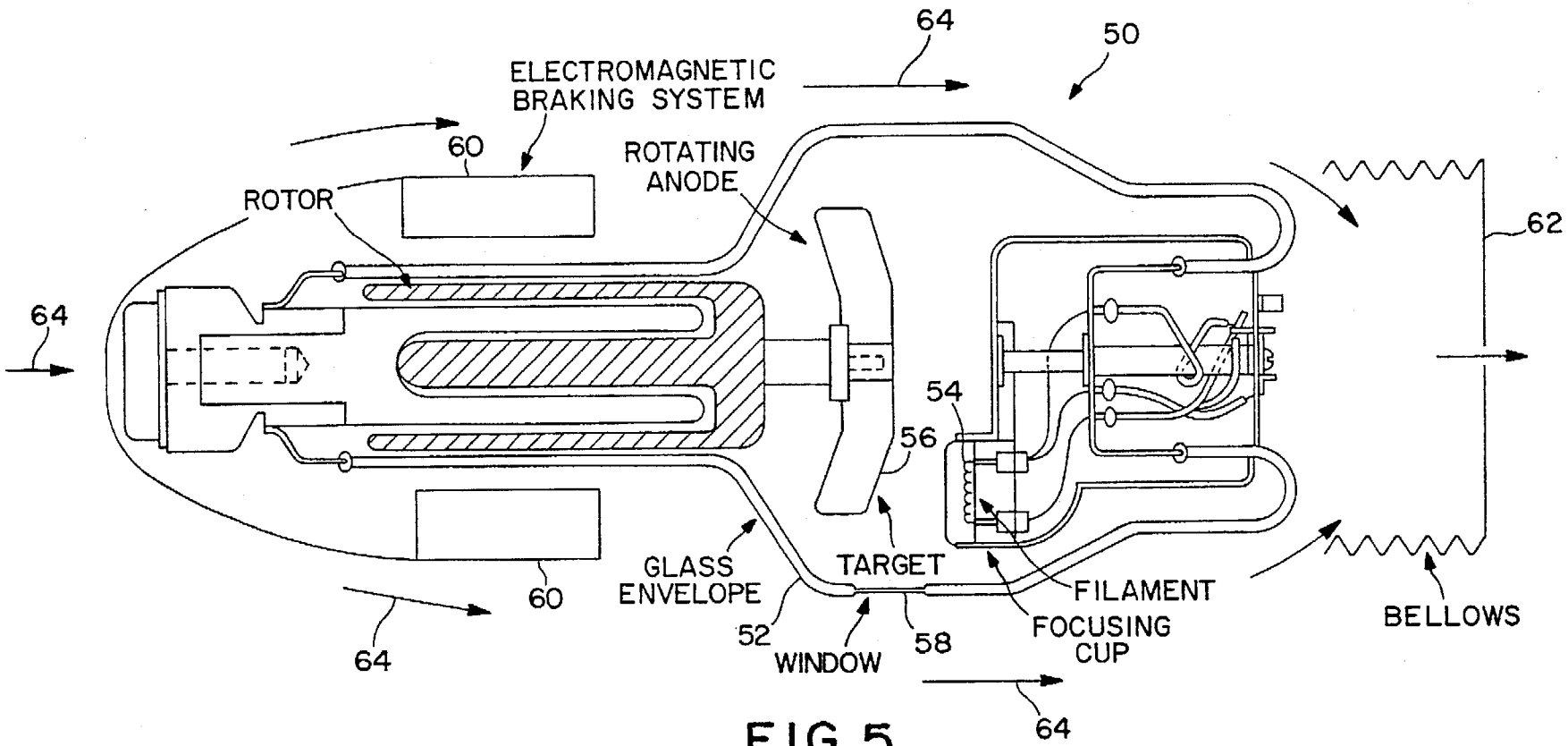
FIG. 5 (PRIOR ART)
FIG. 5 shows additional details of the x-ray tube assembly of FIGS. 1, 2*a*, 2*b*, 2*c*, 2*d* and 3.

Referring to FIG. 5, it should be noted that when an x-ray tube is generating radiation and, consequently, heat, both the temperature and the pressure of the system increase. Thus, most x-ray tube assemblies include a means for accommodating pressure changes in the closed circulation system. For example, some x-ray tube assemblies include a bellows (see FIG. 5) in the closed circulation system which can expand or compress based on the pressure within the system.

However, this device for accommodating pressure changes has practical limits; therefore, it is necessary to take great care when pumping the new into the system so as to not damage this pressure sensitive device (e.g., bellows) and, consequently, the x-ray tube assembly. In the exemplary embodiment of the present invention, the activity of the bellows is monitored by removing a panel on the housing of the x-ray tube assembly, whereby visual inspection is used to monitor the bellows in order that an adequate pumping pressure can be determined and maintained. An alternate monitoring technique is described below with reference to FIG. 14.

Referring back to FIGS. 2*a–c*, the new oil may be filtered before being pumped into the cooling system as shown in FIG. 2*c*. An oil filter 38 can be placed either before (38*b*) or after (38*a*) pump 32 as a precautionary measure to prevent contaminated oil from being pumped into the system.

In the exemplary embodiment of the present invention, a separate pump 32 is used to pump new oil into the system. However, it is contemplated that the pump 35 which is part of the cooling system 17 may, in some way, be used to perform a similar function. The new oil forces the old oil out of system 13 and into old oil container 36.

To determine when to stop pumping new oil into system 13, in the exemplary embodiment, a visual inspection of the oil being flushed from system 13 is made by the individual changing the oil. When the oil flowing into old oil container 36 is substantially clear (or the color of new fluid), then pumping is terminated. Again, this could be accomplished with an in-line window.

As with determining when to change the oil, some additional techniques for determining when to stop pumping have been contemplated and include: (1) installing a monitor system for on-line testing of the thermal and properties of the oil, (2) installing an optical sensor in the exit path which signals when the oil has reached a predetermined color, and/or (3) stopping the flow of new oil based on a predetermined amount of new oil pumped into the system.

Once the flow is stopped, the access point is closed (i.e., quick-action coupling 30 is recoupled) and the cooling system along with the x-ray tube, once again, are a closed system.

It should be noted, however, that during the process of replacing the old oil, air and/or gases may enter the circulation system and become trapped, particularly in the x-ray tube assembly. The air and gases must removed. In the exemplary embodiment of the present invention, an air trap exists in the path of the circulation system to remove the air as it circulates with the oil. It should be noted that the existence of the air trap could be permanent or it could be temporarily installed for oil change purposes.

Figure 4:
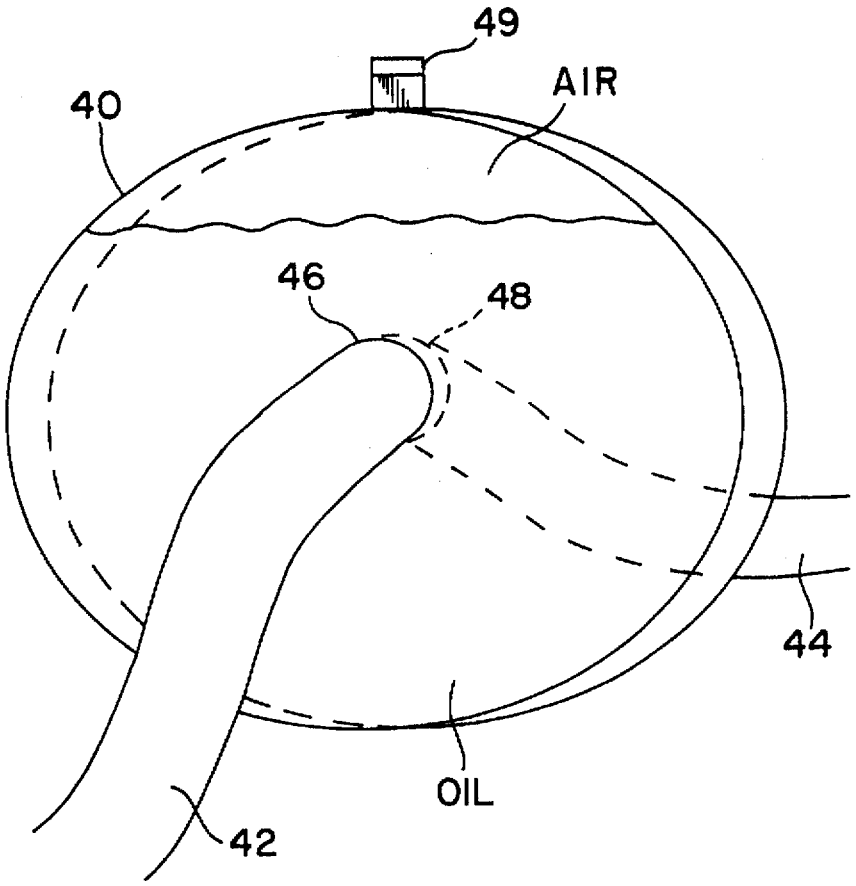
FIG. 4 shows an air trap suitable for use with the invention of FIG. 2*b* and 2*d;*

FIG. 4 shows an air trap 40 suitable for use with the present invention. Air trap 40 is circular so when the gantry (see FIG. 1) rotates the collected air accumulates at the top. Air trap 40 has two openings 46 and 48 opposing one another and approximately located at its center. The openings are coupled to separate tubes 42 and 44 such that circulating oil passes through air trap 40 when travelling from tube 42 to 44. While the circulating oil is in air trap 40, air contained in the oil rises through the oil to the top of air trap 40, hence, removing it from the system. The trapped air can then be released by bleeder 49. An example of such a device is the gas collector made by Siemens in Iselin, N.J. A different apparatus for removing bubbles can be found in U.S. Pat. No. 5,086,449.

After the oil change, the air trap is used by running the cooling system pump 36 in order to circulate the new oil and attempt to trap any air/gas in the system. Typically, the system pump 36 is allowed to run for approximately one hour to ensure that substantially all of the air and/or gas has been removed. However, in the exemplary embodiment of the present invention, the system pump only runs for approximately 15 minutes while the gantry 12 (which houses the x-ray tube 14 and cooling system 17) is tilted and/or rotated in an attempt to dislodge or "free-up" any bubbles trapped in the system so they can circulate and be trapped. The gantry can typically be tilted by±20°–25° and rotated by 360°.

3. Fluoroscopy

In addition to

In addition to the breakdown of the coolant fluid, another problem with an x-ray tube is the vaporization of the anode and filament (both are typically constructed of tungsten) within the glass envelope.

FIG. 5 shows additional details of the x-ray tube assembly. X-ray tube 50 is housed in a glass envelope 52. Within glass envelope 52 is a filament 54 for generating a stream of electrons which bombard an angled, rotating anode 56. The resultant collision creates a planar beam of radiation which is deflected through a window portion 58 of glass envelope 52 and aimed at a patient. Also included in x-ray tube assembly 14 is a braking mechanism 60 for settling a rotating anode and a bellows 62 for accommodating pressure changes in the closed circulation system. Arrows 64 indicate the direction of oil flow through x-ray tube assembly 14.

Because of the high temperature of filament 54 during operation, tungsten atoms are slowly vaporized and plate the inside of glass envelope 52, even with normal use. This tungsten, along with that vaporized from anode 56, disturbs electrical balance of the x-ray tube, causing abrupt, intermittent changes in tube current, which often leads to arcing and tube failure.

To minimize, if not eliminate, the likelihood of this problem thereby further extending the service life of the x-ray tube, regular on-line fluoroscopies are performed. A on-line fluoroscopy substantially reduces the condition (i.e., also known as a "gassy" condition) caused by the vaporized tungsten.

Figure 6:
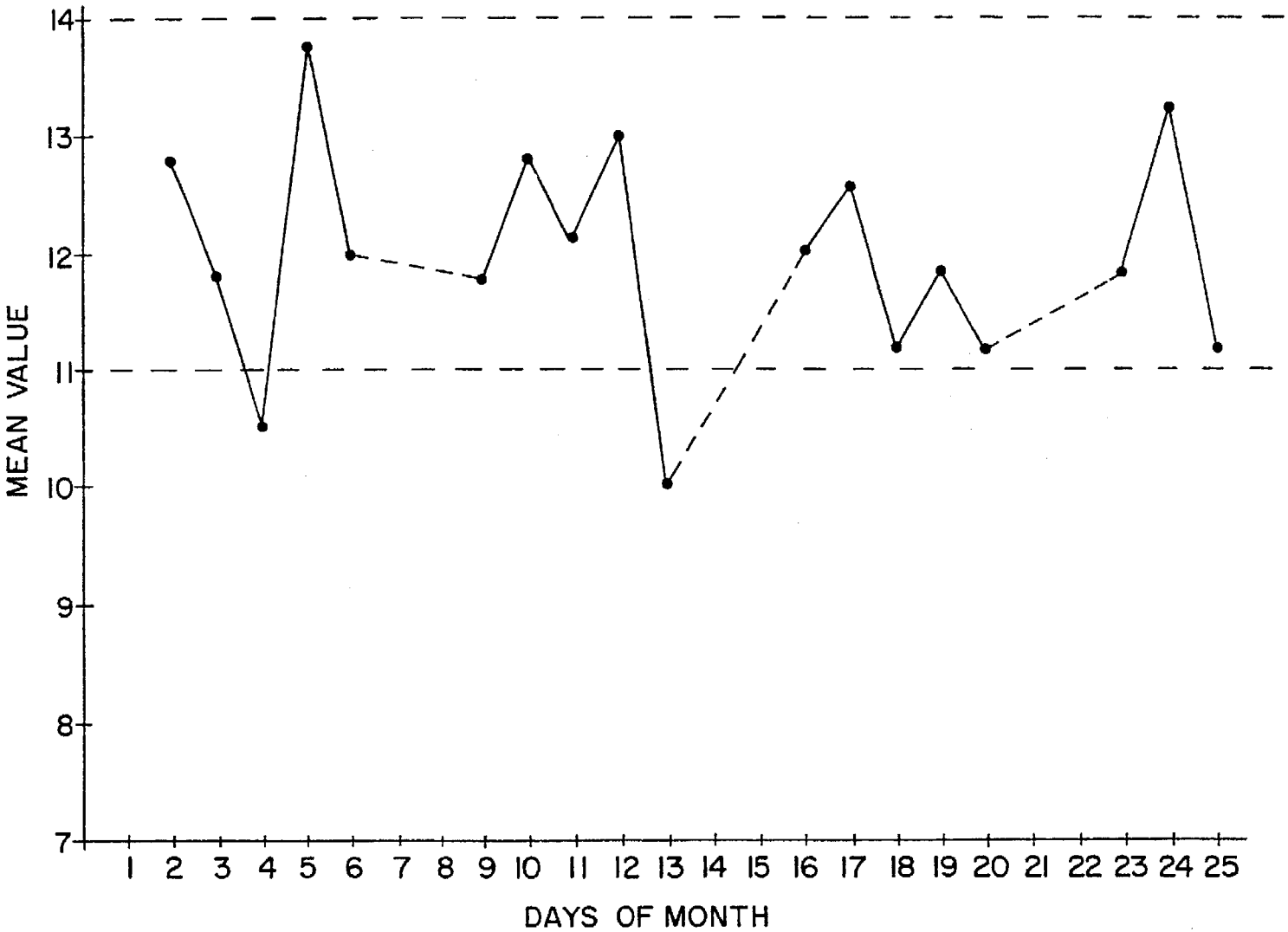
FIG. 6 shows a chart of daily calibration results for detecting a gassy condition.

To determine when a fluoroscopy is needed, a technician or other equally skilled individual should periodically analyze the results of the daily CT scanner calibration. As the intensity of the radiation during a calibration (i.e., phantom test) continues to diminish over time, a threshold can be set to indicate the need for an on-line fluoroscopy. FIG. 6 is an example of a chart tracking daily test results for a CT scanner. In FIG. 6, the Y-axis represents a mean value indicative of the beam intensity, while the X-axis tracks the days of a month. A value of 7 is typically achieved with a new x-ray tube and the range from approximately 11 to 14 indicates a gassy condition.

It should be noted that, in the exemplary embodiment of the present invention, the on-line fluoroscopy is performed along with the above-described fluid change in order to make efficient use of a CT scanner's down time.

The on-line fluoroscopy requires that the CT scanner system generator be set to deliver 125 kilovolts at 3–5 milliamps (versus 125 kv and 400 ma for several seconds for typical beam generation). This setting is maintained for approximately ½ hour at which time the CT scanner is recalibrated in order to gauge the improvement gained by the on-line fluoroscopy.

It should be noted that for some systems such as Siemens CT with micromatic generator, the on-line fluoroscopy requires the individual performing the fluoroscopy to remain with the system controls for the full ½ hour; whereas, other systems such as Siemens CT with Pandoras generator only require the individual to set the generator and return in approximately ½ hour.

4. Braking Mechanism

In addition to the generation of radiation being a source of heat, heat is also generated by a braking mechanism 60 used to settle rotating anode 56. Eventually, braking mechanism 60 as well as failing bearings (not shown) are also a source of discomforting noise.

Experiments show that the braking of the rotating anode 56 may produce adverse affects, especially to the bearings of rotating anode 56.

Thus, in an alternate embodiment of the present invention, in addition to the above-described techniques for extending the service life of an x-ray tube, the braking mechanism 60 for the rotating anode is often disabled (i.e., the wires are disconnected). This means that after radiation has been generated, rotating anode 56 is allowed to continue rotating until it settles on its own without the assistance of braking mechanism 60.

Cart Design

In the exemplary embodiment of the present invention, a cart which, preferably, is mobile, portable or otherwise easy and convenient to operate has been designed to perform various aspects of the present invention. For example, the exemplary embodiment of the cart allows a technician or other skilled individual to connect the cart to a source of new oil for the purpose of filling its new oil reservoir container, this being known as the FILL mode. Also, the cart design allows the same individual to connect the cart to the cooling system and perform operations such as 1) replacing the existing oil with new oil (FLUSH mode), 2) circulating existing oil, whether new or old, through the circulation system as well as any filters coupled in-line with the circulation path (RECIRCULATE mode), and 3) add new oil to the cooling system from the reservoir (TRIM mode).

Figure 7A:
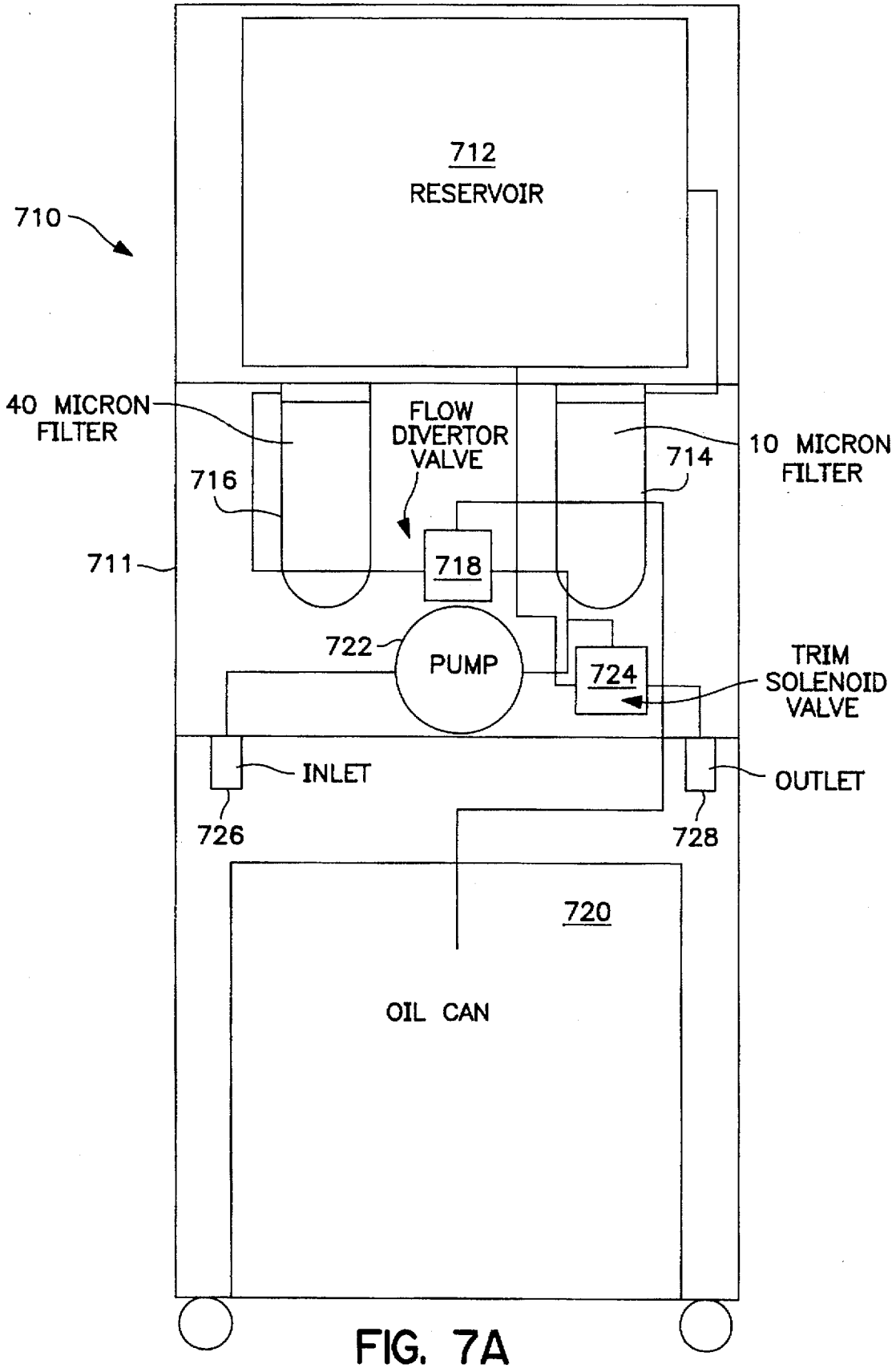
FIG. 7A shows an exemplary cart design for many purposes including removing, replacing, recirculating and filtering the cooling system fluid.

FIG. 7A shows an exemplary embodiment of a cart design suitable for use with the present invention. As shown, cart 710 includes a housing 711, a reservoir 712 coupled to a series of filters 714, 716 which, in the exemplary embodiment, are a 10 micron cellulose filter and a 40 micron synthetic polyester filter. The 10 micron filter filters minute contaminant particles but not smaller than 10 microns in size. And, the 40 micron filter filters large contaminant particles greater than 40 microns in sizer. It is noted that filters 714 and 716 are optional based on a user's desire to perform a filtering operation. Because filters 714 and 716 are optional, they can be connected to the system within the cart 710 via connectors (see FIG. 7B) allowing their convenient removal or insertion. It is noted that reservoir 712, in the exemplary embodiment, is constructed at least in part of stainless steel and can serve as a means for viewing the fluid to determine its condition and it can also serve as an air trap when properly interconnected. In the exemplary embodiment, reservoir 712 is also equipped with fluid level indicators for the convenience of the user. It is also noted that, in the exemplary embodiment, housing 711 includes a rugged, transport hand truck for mobility as well as stability.

Continuing with FIG. 7A, filter 716 is coupled to a flow divertor valve 718 which can direct the flow of fluid toward the oil can 720 which is generally used to contain waste oil or toward pump 722 and trim solenoid valve 724. It should be noted that pump 722 is bidirectional, therefore, fluid can flow in either direction from pump 722.

Pump 722 is also connected to an inlet 726 which can be coupled to the coolant system or a source of new oil by way of appropriate hoses or tubing. Trim solenoid valve 724 is also coupled to reservoir 712 and outlet 728. Outlet 728, like inlet 726, can be coupled to the coolant system or other appropriate containers by way of appropriate hoses or tubing.

It should be noted that, alternatively, it is contemplated that various aspects of the cart may be incorporated in the coolant system rather than integrated into an apparatus such as the cart. For example, one or more of the above-described optional filters could reside with the x-ray tube in the CT scanner.

In addition, cart 710 may be equipped with certain safety features. For example, in the exemplary embodiment of the present invention, cart 710 includes two safety pressure switches capable of disabling the cart and associated circuitry if the pressure being monitored exceeds some predetermined limits.

Figure 7B:
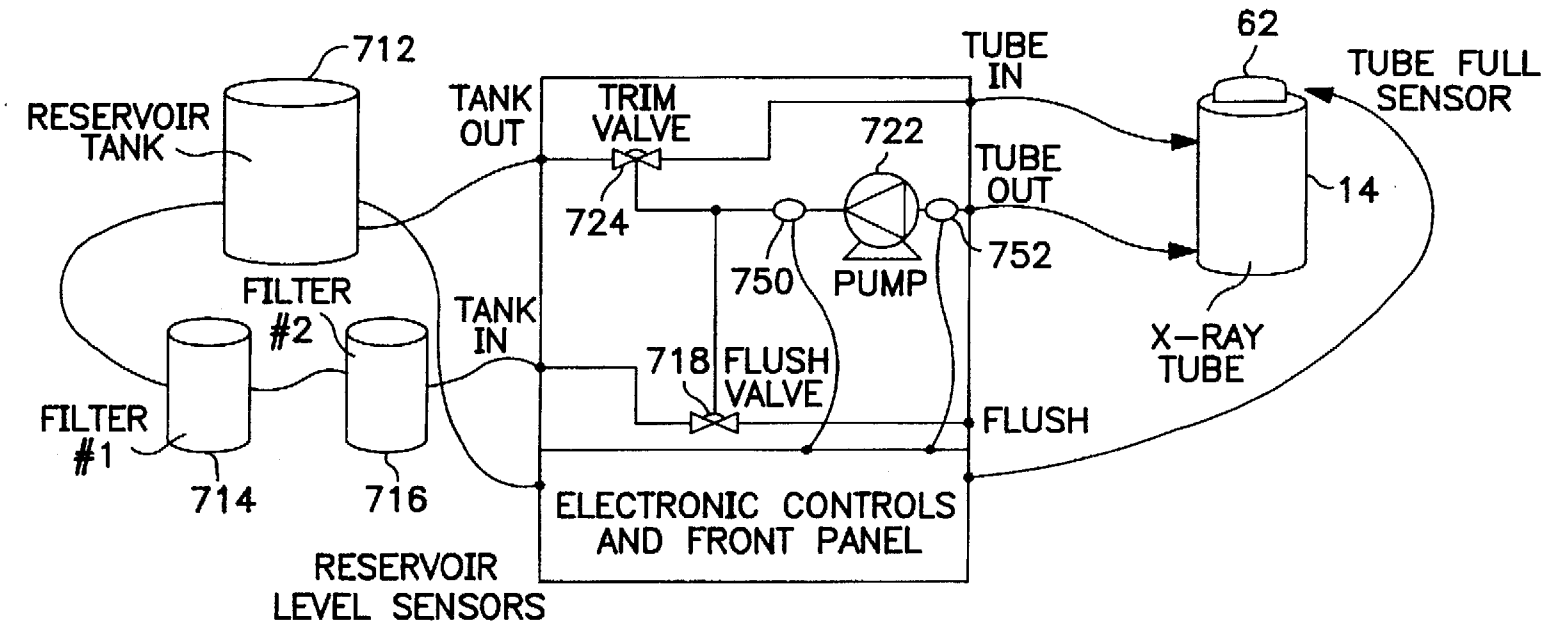
FIG. 7B shows another exemplary cart design including safety pressure switches.

In particular, FIG. 7B shows another functional view of an exemplary cart 710 further including safety pressure switch 750 and safety pressure switch 752. As shown in FIG. 7B, pressure switch 750 is coupled proximate to the pump. Pressure switch 750 is used to monitor the pressure, for example having a limit of about 30 psiq, to prevent a dangerous pressure build up (e.g., an obstruction occurs within a line). If such a pressure build up should occur, it could cause hosing or other sections of cart 710 to burst, thereby, endangering the safety of a user or other machines nearby. Similarly, pressure switch 752 is also coupled proximate to the pump but between the pump and a tube out connection. Pressure switch 752 is used to monitor the pressure, for example having a limit of about 1–5 psig, during a TRIM operation described below in more detail. In the exemplary embodiment of the present invention, safety pressure switch 750 is directly coupled to the start/stop circuitry (see FIG. 9) and safety pressure switch 752 is directly coupled to the trim circuitry through a relay (see FIG. 9). In each case, either the system or the particular operation is disabled to avoid a dangerous pressure build up. It is contemplated that both pressure limits are variable (i.e., programmable).

Oil flow diagrams and circuit schematics are described below for each of the modes carried out by the exemplary cart design.

FILL mode

Figure 8:
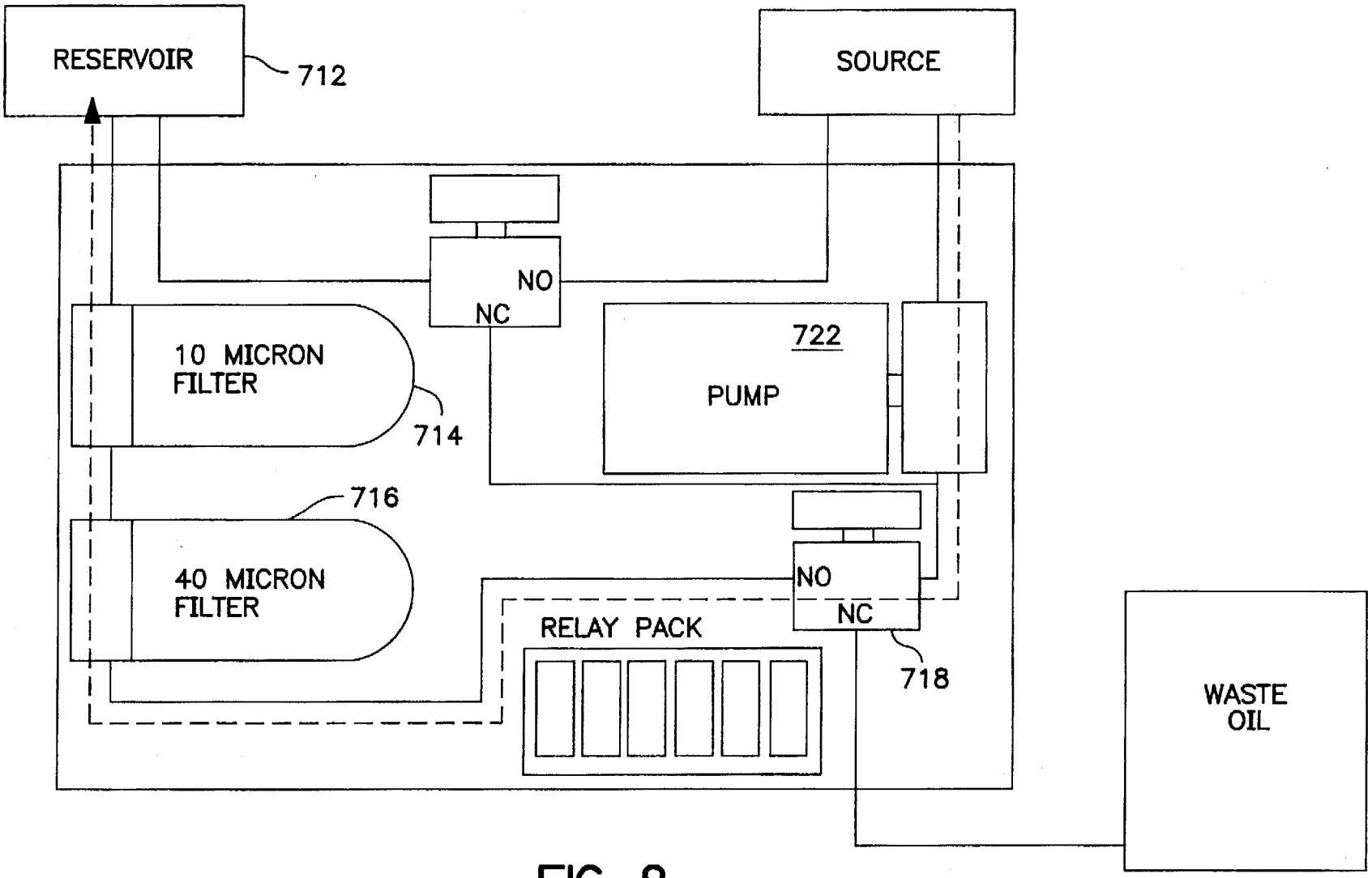
FIG. 8 shows a schematic diagram of the flow of the coolant in a FILL mode.

FIG. 8 shows a schematic diagram of the flow of the coolant in the FILL mode. As seen in FIG. 8, when the FILL mode is activated, the pump 722 uses negative pressure, essentially a suction effect, to draw oil (flow represented by dotted lines) from a source through flow diverter valve 718 through the 40 micron filter 716 and 10 micron filter 714 and into the reservoir 712. As mentioned above, the purpose of this mode is to be able to fill the reservoir with new, clean oil. It should be noted that the designations "NO" and "NC" depicted on the valves stand for "Normally Open" and "Normally Closed", respectively.

Figure 9:
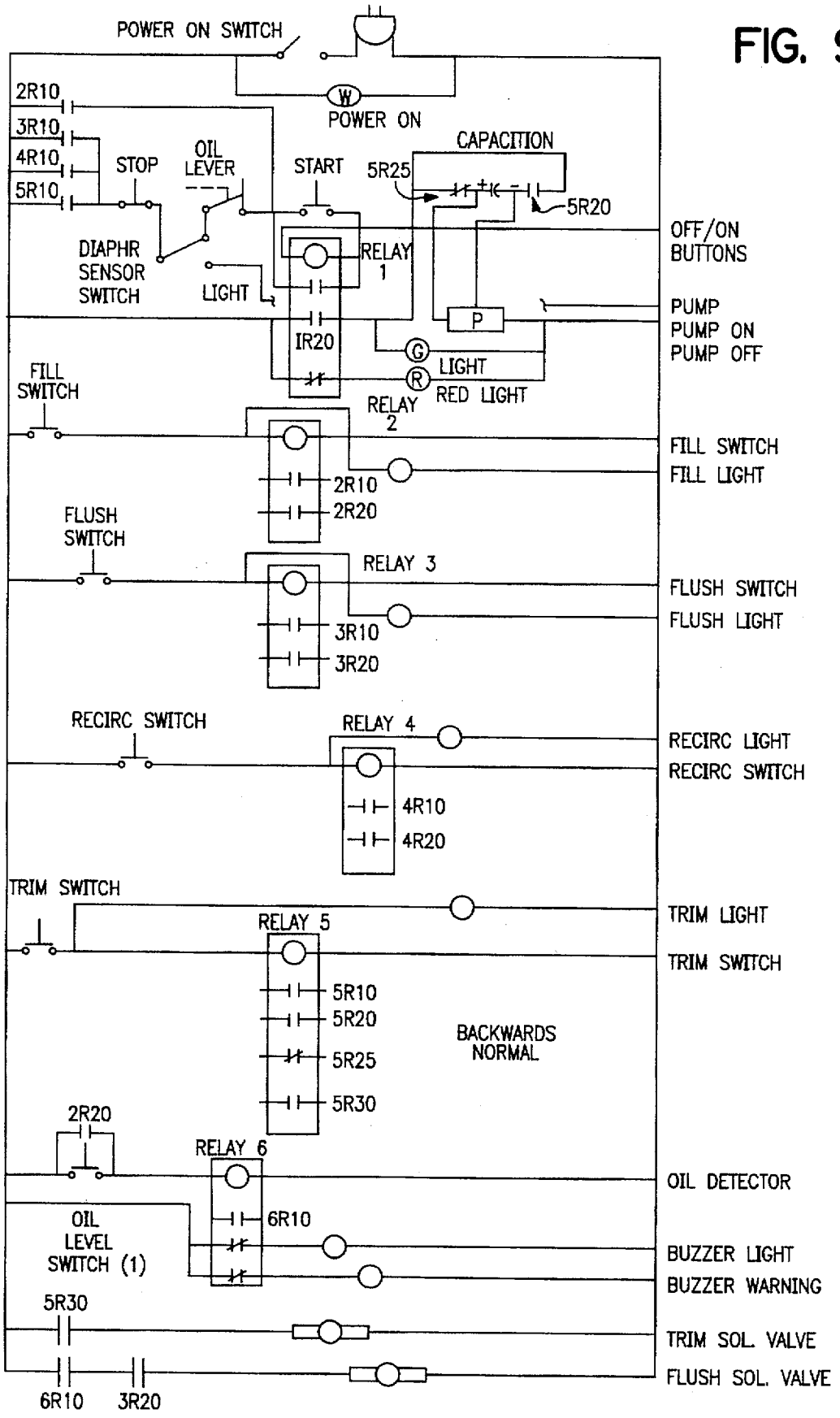
FIG. 9 shows a circuit diagram of the electrical connections which may occur during the various modes including FILL mode.

FIG. 9 shows the schematic for the circuitry built into the cart which, as will be appreciated by those skilled in the art, includes relays, switches, lights, alarms, etc. In particular, FIG. 9 shows that different sections of the circuit are dedicated to different modes of operation such as the FILL mode while other sections of the circuit are used for general control regardless of the particular mode such as providing power.

Figure 13:
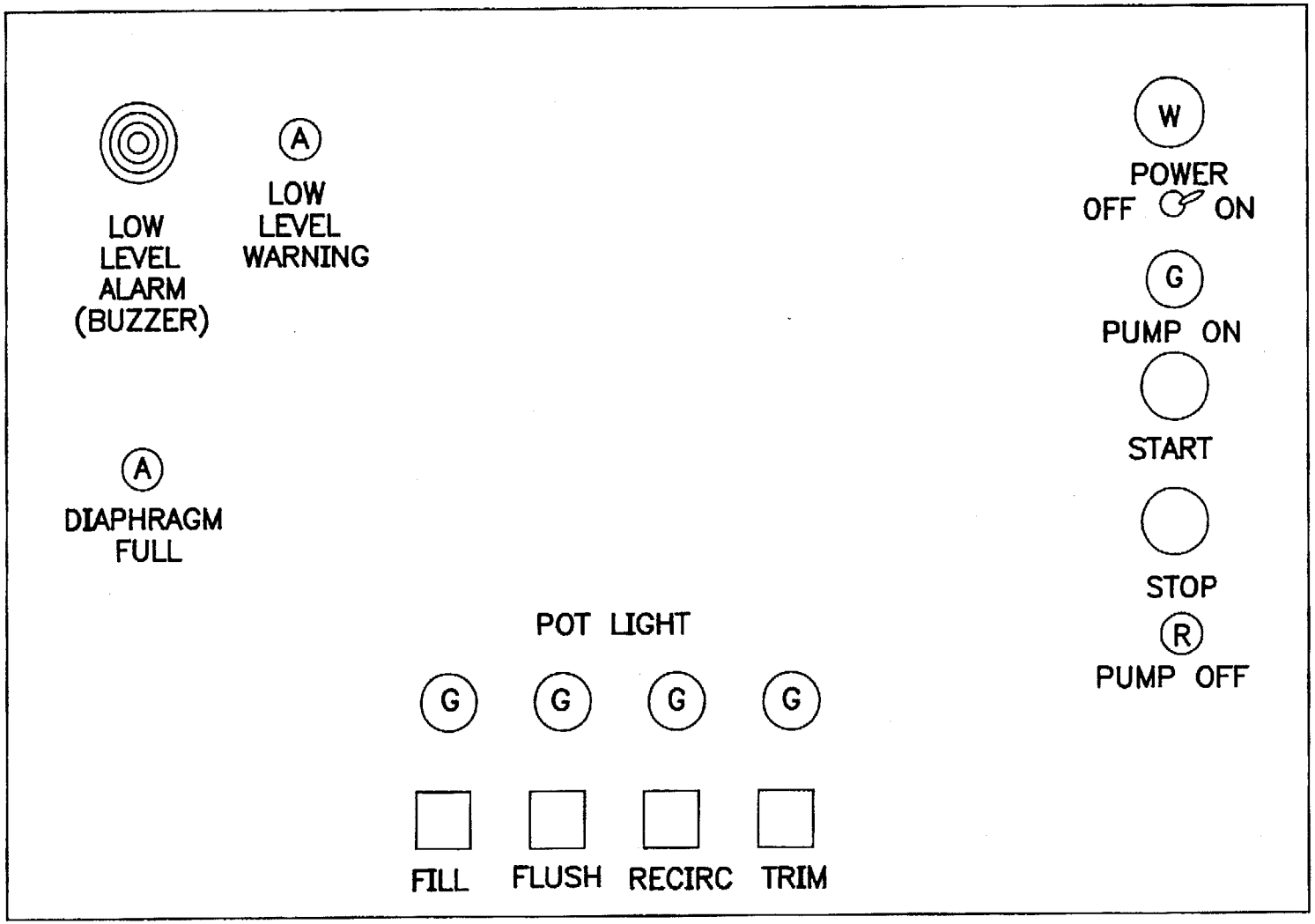
FIG. 13 shows a top view of a control panel suitable for use with the cart design illustrated in FIGS. 7–12.

The circuit shown in FIG. 9 is described with reference to FIG. 13 which shows a top view of the cart control panel including START and STOP switches, MODE selection switches, LED indicators, and alarms for carrying out the various modes.

In operation, the first step would be to actuate the POWER 0N switch on the control panel which corresponds to the POWER ON switch shown in FIG. 9. This provides power to the circuit. Next, refering to FIG. 13, a mode would be selected, for example the FILL mode switch would be activated. In doing so, the relay associated with FILL mode (RELAY 2) would be actuated and the appropriate connections would be made. For RELAY 2, the connections to be made are designated by 2R10 and 2R20. These two connections are respectively found at the top lefthand corner of FIG. 9 and the bottom lefthand corner of FIG. 9. Once the mode selection has been made, the cart operator need only use the START and STOP switches to carry out a particular operation. It should be noted in the exemplary embodiment of the present invention, the START and STOP switches are manually controlled; however, it is contemplated that timing circuitry could be added to further automate the various modes of operation.

It should also be noted that the circuitry shown in FIG. 9 is also designed to monitor various characteristics of the system for safety and efficiency concerns. For example, a diaphram sensor switch is used in series with the START and STOP switches such that if the sensed pressure exceeds a predetermined threshold, the pump stops pumping to avoid damage.

Figure 14:
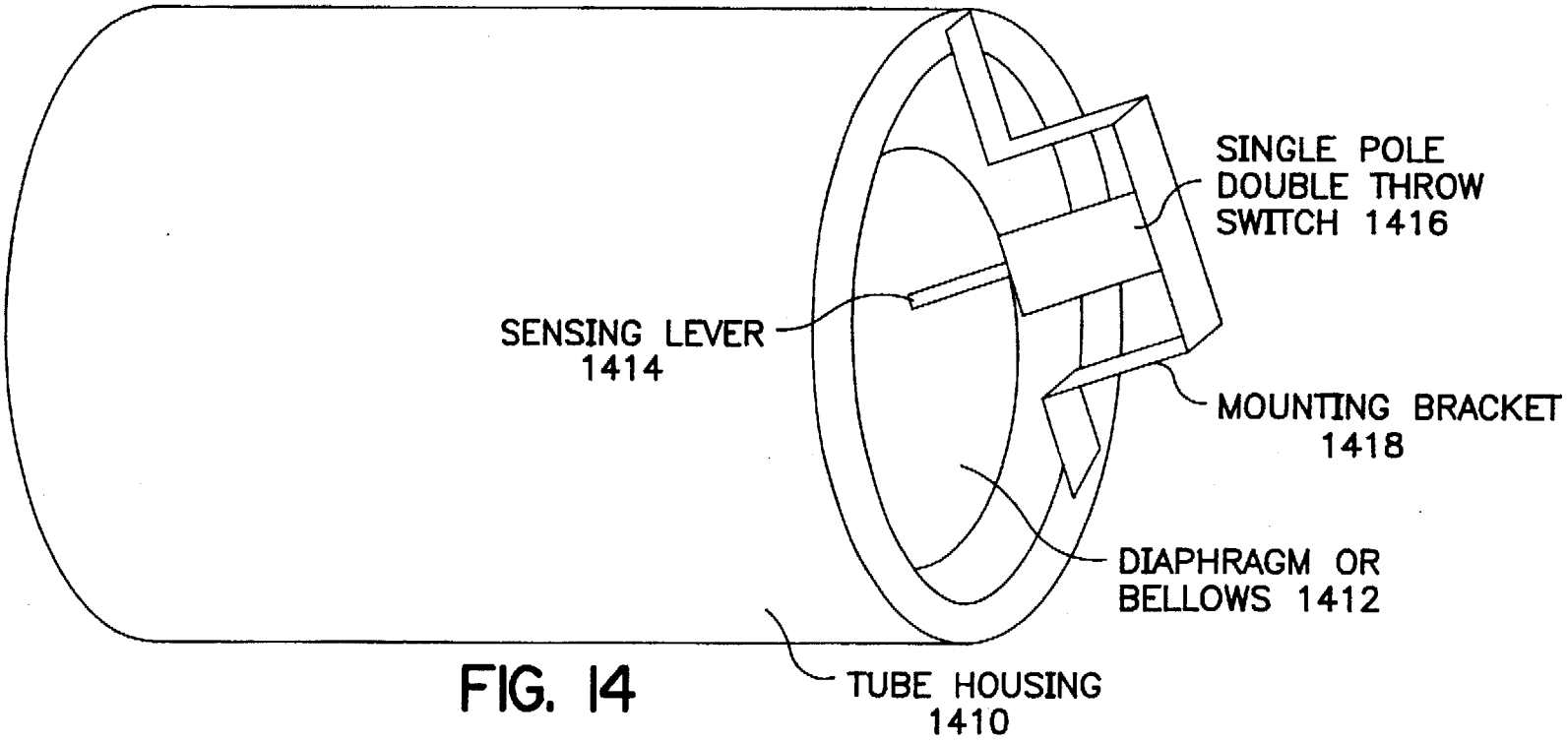
FIG. 14 shows an exemplary embodiment of a diaphram switch sensor suitable for use with the present invention.

FIG. 14 shows an exemplary embodiment of a diaphram switch sensor suitable for use with the present invention. As shown, within x-ray tube housing 1410 is contained a diaphram or bellows 1412 (also shown in FIG. 5). A sensing lever 1414 is coupled to a switch 1416 which, in the exemplary embodiment of the present invention, is a single pole, double throw switch. This switch is connected via appropriate connections (e.g., ribbon cable) to the diaphram sensor switch shown in FIG. 9. The lever 1414 and the switch 1416 are connected to a mounting bracket 1418 which is secured to the tube housing 1410.

In operation, the lever 1414 is operatively positioned such that excessive expansion by the bellows 1412 actuates the switch 1416 and shuts down the pump 722, thereby preventing diaphram rupture and potentially significant damage.

FLUSH mode

Figure 10:
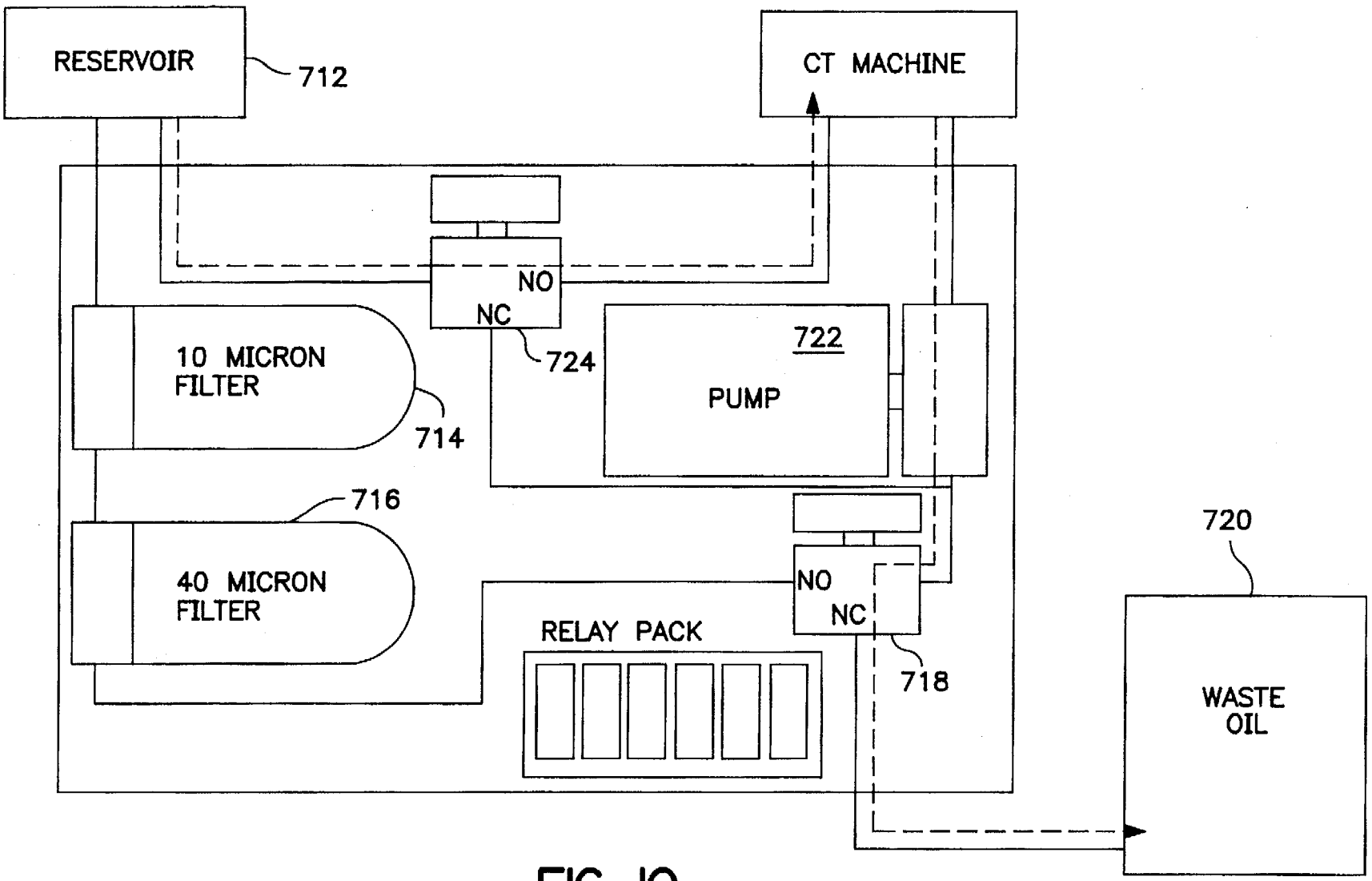
FIG. 10 shows a schematic diagram of the flow of the coolant in a FLUSH mode.

FIG. 10 shows a schematic diagram of the flow of the coolant in FLUSH mode. As seen in FIG. 10, oil flows (flow represented by dotted lines) from the CT machine via the pump 722 to flow divertor valve 718 into the used oil container 720. At the same time, the negative pressure created by pump 722 draws oil from the new oil reservoir 712 through the valve 724 into the CT machine. By activating valve 724 and coupling the reservoir to CT machine, the negative pressure or suction effect from the pump 722 is sufficient to not only draw out the existing oil from the CT machine but also to draw in the new oil from the reservoir 712 into the CT machine. It should be noted that the designation "CT machine" is used show connections to the circulation system within the CT scanner.

Referring back to FIG. 9, the appropriate electrical connections for performing the FLUSH mode are accomplished in a manner similar to that described above with reference to the FILL mode except the FLUSH mode is selected.

RECIRCULATE mode

Figure 11:
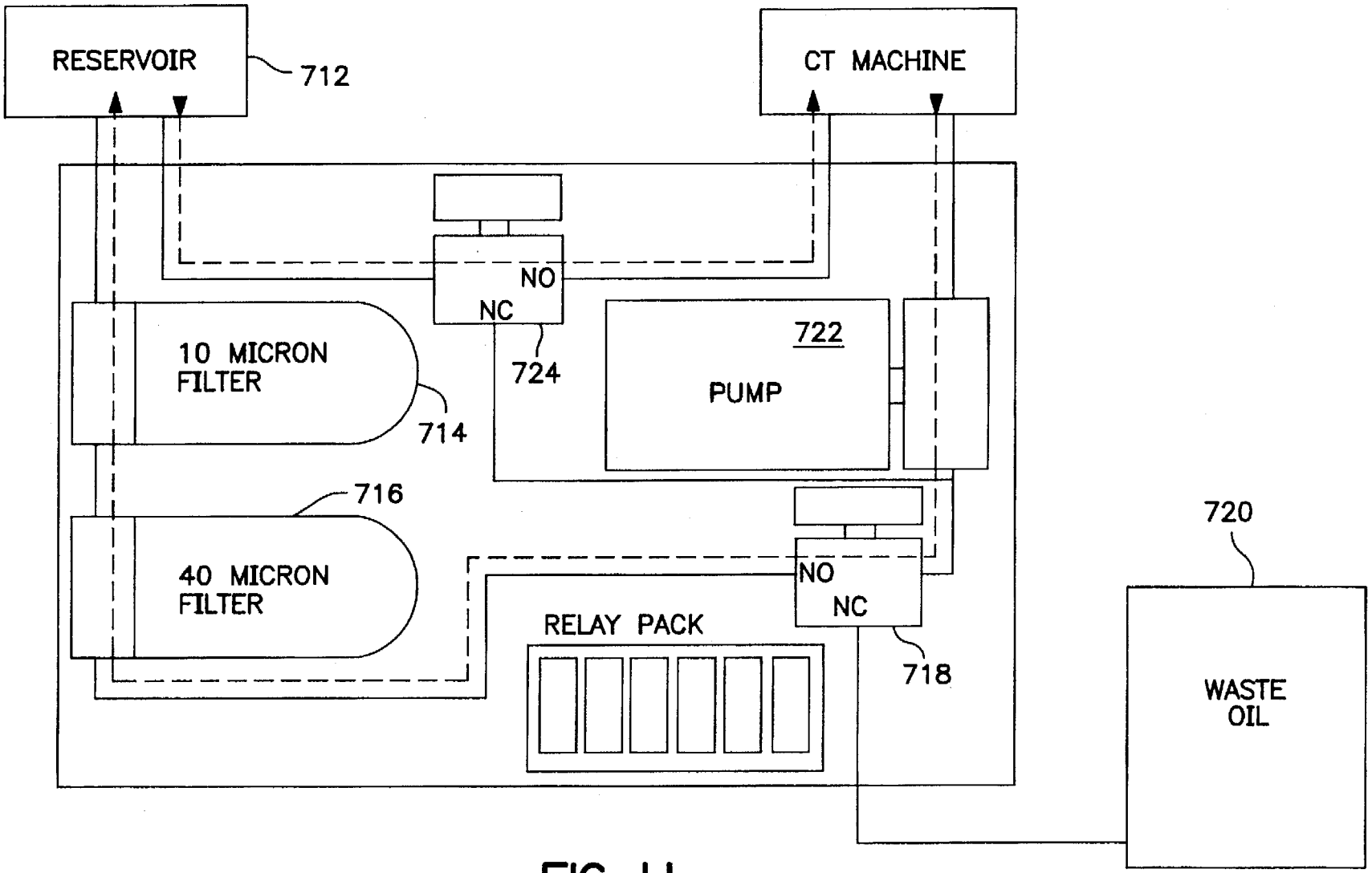
FIG. 11 shows a schematic diagram of the flow of the coolant in a RECIRCULATE mode.

FIG. 11 shows a schematic diagram of the flow of the coolant in RECIRCULATE mode. As seen in FIG. 11, oil is drawn (flow represented by dotted lines) from the CT machine by the pump 722, passes through flow diverter valve 718 through the filters 716, 714 into the reservoir 712 which, in turn, is coupled through valve 724 to the CT machine creating a complete loop through which the oil can circulate. This mode provides a technique for being able to filter new or existing oil.

Referring back to FIG. 9, the appropriate electrical connections for performing the RECIRCULATE mode are accomplished in a manner similar to that described above with reference to the FILL mode except the RECIRCULATE mode is selected.

TRIM mode

Figure 12:
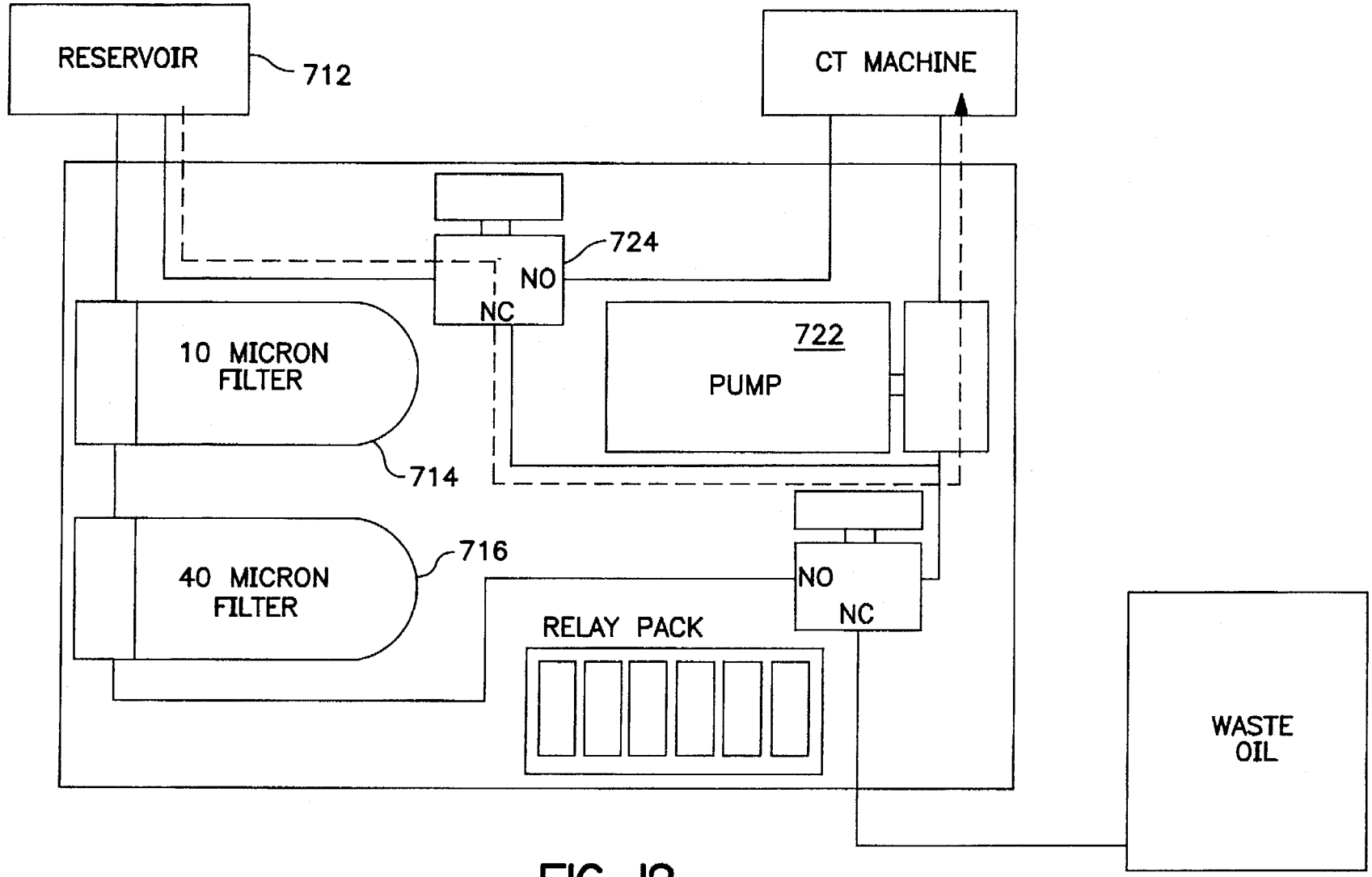
FIG. 12 shows a schematic diagram of the flow of the coolant in a TRIM mode.

FIG. 12 shows a schematic diagram of the flow of the coolant in TRIM mode. As seen in FIG. 12, oil-is drawn (flow represented by dotted lines) from the reservoir 712 through the trim solenoid valve 724 back into the CT machine via the pump 722. It should be noted that, in the exemplary embodiment of the present invention, in this particular mode, the pump 722 is using positive pressure rather than negative pressure to push the oil into the CT machine rather than drawing the oil from the CT machine.

Referring back to FIG. 9, the appropriate electrical connections for performing the TRIM mode are accomplished in a manner similar to that described above with reference to the FILL mode except the TRIM mode is selected.

Although the invention is illustrated and described herein embodied as a method and system of performing regular fluid changes or filterings for CT x-ray tubes, the invention is nevertheless not intended to be limited to the details as shown. Rather, various modifications may be made in the details within the scope and range of equivalents of the claims and without departing from the spirit of the invention.

What is claimed:

1. In a radiographic apparatus having an x-ray tube coupled to a cooling system and the cooling system circulates an existing fluid through a closed circulation system which includes the x-ray tube, a method for extending the service life of the x-ray tube without removing the x-ray tube from the apparatus comprising the steps of:

a) determining, based on predetermined criteria, that the existing fluid has degraded below a predetermined tolerance;

b) opening the closed circulation system to gain access to the existing fluid;

c) replacing the existing fluid by way of the opening in step b); and d) closing the circulation system.

2. The method according to claim 1 further comprising the step of:

e) removing, from the closed circulation system, any gas introduced during steps b) through d).

3. The method according to claim 1 further comprising the steps of:

e) determining, based on further predetermined criteria, that an on-line fluoroscopy be performed; and f) performing said on-line fluoroscopy.

4. The method according to claim 1, wherein said x-ray tube includes a braking mechanism to settle a rotating anode, further comprising the step of:

e) disabling said braking mechanism.

5. The method according to claim 1, wherein said x-ray tube includes a pressure sensitive means for accommodating pressure changes within said closed circulation system, further comprising the step of:

e) monitoring said pressure sensitive means to determine and maintain the flow of existing fluid in step c).

6. In a radiographic apparatus having an x-ray tube coupled to a cooling system and the cooling system circulates an existing fluid in a closed circulation system including the x-ray tube to remove heat and provide electrical insulation, a method for extending the service life of the x-ray tube without removing the x-ray tube from the apparatus comprising the steps of:

a) determining, based on first predetermined criteria, that the existing fluid has degraded beyond a predetermined tolerance;

b) opening the closed circulation system, to provide first and second openings;

c) coupling a means for replacing the existing fluid between said first and second openings;

d) replacing the existing fluid;

e) determining, based on second predetermined criteria, that the existing fluid has been sufficiently replaced; and f) removing the means for replacing and closing the first and second openings of the closed circulation system.

7. The method according to claim 6 further comprising the step of:

g) removing any gas introduced during steps b) through f) from the closed circulation system.

8. The method according to claim 6 further comprising the steps of:

g) determining, based on third predetermined criteria, that an on-line fluoroscopy be performed;

h) performing said on-line fluoroscopy.

9. The method according to claim 6, wherein said x-ray tube includes a braking mechanism to settle a rotating anode, further comprising the step of:

g) disabling said braking mechanism.

10. The method according to claim 6, wherein said x-ray tube includes a pressure sensitive means for accommodating pressure changes within said closed circulation system, further comprising the step of:

g) monitoring said pressure sensitive means to determine and maintain the flow of existing fluid in step d).

11. In a radiographic apparatus having an x-ray tube coupled to a cooling system, wherein the cooling system circulates an existing fluid through a closed circulation system which includes the x-ray tube, a system for providing various functions with respect to the existing fluid in order to extend the service life of the x-ray tube without removing the tube from the apparatus comprising:

reservoir means for storing fluid;

valve means for directing fluid flow to achieve a predetermined direction of fluid flow;

used fluid container means for storing used fluid;

pump means for creating a fluid pressure differential in order to pump fluid in a predetermined direction of fluid flow, said reservoir means, valve means, used fluid container means and pump means interconnected to provide for various functions with respect to existing fluid;

housing means for housing the reservoir means, valve means, used fluid container means and pump means to cause them to be mobile; and connection means for providing connection points between the means contained within the mobile housing means and the closed circulation system.

12. The system according to claim 11, wherein said x-ray tube includes a pressure sensitive means for accommodating pressure changes within said closed circulation system, further including pressure sensing means for monitoring said pressure sensitive means to determine and maintain the flow of existing fluid during pumping by the pump means.

13. The system according to claim 11, further including flow pressure sensing means for monitoring a pressure of fluid flow through the system.

14. The system according to claim 13, wherein the flow pressure sensing means disable the system when the monitored pressure exceeds a predetermined limit.

15. The system according to claim 11, wherein the reservoir means functions as an air trap.

16. The system according to claim 11, wherein the housing means is mobile.

17. In a radiographic apparatus having an x-ray tube coupled to a cooling system, wherein the cooling system circulates an existing fluid through a closed circulation system and the x-ray tube, a system for changing the existing fluid in order to extend the service life of the x-ray tube without removing the x-ray tube from the radiographic apparatus comprising:

source of new fluid;

pump means, coupled between said source of new fluid and said closed circulation system, for pumping said new fluid into said closed circulation system to force out said existing oil; and container means for receiving said existing fluid being forced out of said closed circulation system by said new fluid.

18. The system of claim 17, further comprising an air trap means, coupled within said closed circulation system, for trapping air or gases within said closed circulation system.

* * * * *